United States Patent [19]

Persson

[11] 3,935,404

[45] Jan. 27, 1976

[54] TIMER SWITCH ASSEMBLY

[76] Inventor: Holger Persson, 5941 Emerson Ave. S., Minneapolis, Minn. 55430

[22] Filed: Oct. 21, 1974

[21] Appl. No.: 516,794

[52] U.S. Cl. ..... 200/35 R; 200/38 R
[51] Int. Cl.[2] ..... H01H 43/00
[58] Field of Search ..... 200/33 R, 35 R, 38; 58/21.13, 21.15, 39.5

[56] References Cited

UNITED STATES PATENTS

| | | | |
|---|---|---|---|
| 2,798,124 | 7/1957 | Sharbaugh | 200/38 A X |
| 3,204,052 | 8/1965 | Wiser et al. | 200/38 B |
| 3,264,478 | 8/1966 | Moldovan | 200/38 A X |
| 3,319,019 | 5/1967 | Jullien-Davin | 200/38 R |
| 3,478,181 | 11/1969 | Buckerridge et al. | 200/38 B |
| 3,649,783 | 3/1972 | Voland et al. | 200/38 FA |
| 3,652,814 | 3/1972 | Kanazawa et al. | 200/38 B X |
| 3,825,702 | 7/1974 | Murata et al. | 200/38 R X |

*Primary Examiner*—James R. Scott
*Attorney, Agent, or Firm*—Donald A. Jacobson

[57] ABSTRACT

A device for randomizing the operation of an electrical switch such that it can be used to switch electrical devices at random time intervals. This device uses a mechanism which periodically disconnects a drive train from a motor, randomizes the position of the drive train, and uses the resultant position of the mechanism to trip an electrical switch.

9 Claims, 8 Drawing Figures

TIMER SWITCH ASSEMBLY

BACKGROUND OF THE INVENTION

This invention relates generally to an operating mechanism for an electrical switch and more specifically to a device which is operative to periodically alter the time of operation of said switch in a random fashion.

There are many applications where a random time interval may be useful. For example, in complex systems wherein the occurrance of random events may impinge to deleteriously alter the results of the system operation, a randomly switched signal may be useful for test purposes. Another use of a random switching mechanism is in the control of lights in an unoccupied building to give the illusion that the lights are being operated by the occupants, thereby discouraging burglary attempts.

Prior art motor driven switch operating mechanisms are well known in the art. Residential light switching devices having a timer mechanism are commercially available. However, all such prior art devices operate on a fixed interval basis. That is, when set, the lights are turned on at a given time each evening and turned off at a given time each morning, or at some other previcusly determined fixed interval. Typical of such prior art is the invention described in the Gruber Pat. No. 3,748,490.

SUMMARY OF THE INVENTION

The present invention differs from the prior art in that the switch control mechanism serves to activate the switch at random time intervals rather than at fixed intervals.

In accomplishing this result, the device utilizes a motor coupled to a randomizing drive element which is periodically disconnected from the motor and switch at fixed time intervals and permitted to rotate to a random position. The drive element will only trip the switch at one point in its rotation and as a consequence of the randomizing sequence, the interval between switch closings and openings is also made random.

OBJECTS

It is accordingly the principal object of the present invention to provide a new and improved device for controlling the on-off state of an electrical switch.

Another object of the present invention is to provide a switch operating mechanism operative to cause activation of the switch at random rather than fixed intervals.

Still another object of the invention is to provide a random time interval switch opening and closing mechanism readily adapted to the operation of lighting circuits to give the illusion of human occupancy of unoccupied buildings as a burglary deterrent.

A further object of the present invention is to provide a new random interval switch operating mechanism using a device which is extremely simple in design, easy to use, with a minimum of moving parts, and which is accordingly economical and easy to manufacture and possesses a long and safe operational life.

BRIEF DESCRIPTION OF THE DRAWINGS

These and other objects and advantages of the invention will become apparent to those skilled in the art from a reading of the following detailed description when considered in conjunction with the accompanying drawings in which:

in FIG. 6.

DETAILED DESCRIPTION OF THE PREFERRED EMBODIMENT

Figure 1:
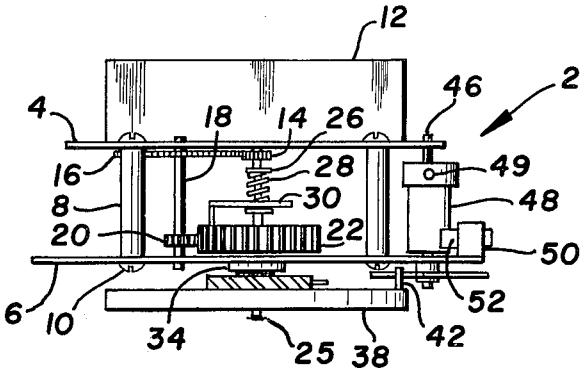
FIG. 1 is a top view of the preferred embodiment.
Figure 2:
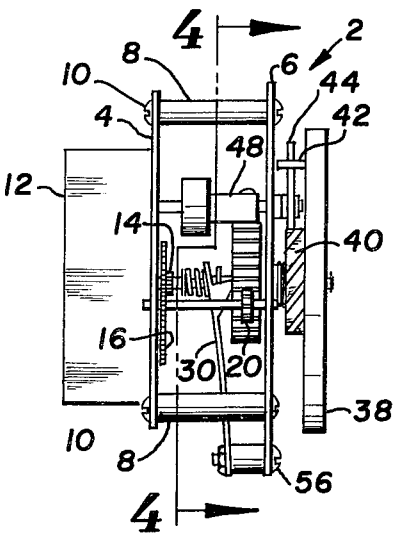
FIG. 2 is the left side view of the device.

Referring first to FIG. 1, the top view of the preferred embodiment showing the supporting structure, motor and drive train is presented. In the following description, up, down, right, and left refer to the relative position on the drawings when viewed in the normal upright position. The terms, in and out, refer to the surface of the mechanism itself. The random switch is indicated generally by the numeral 2. It includes a rear supporting plate 4 and forward supporting plate 6 which are separated and maintained parallel by four spacers 8, only two of which show in FIG. 1. The plates may be secured to the spacers 8 by screws 10 or other suitable fasteners (FIG. 2).

A motor 12 drives a gear 14, which is attached to the motor's shaft and which, in turn, extends through a hole provided in plate 4. Gear 14, in turn, drives a gear 16. Gear 16 is secured to and drives a shaft 18. Shaft 18 has a gear 20 mounted on its opposite end. Shaft 18 is mounted for rotation in opposing holes in plates 4 and 6. Gear 20 drives a gear 22 which is mounted on a shaft 24 but passes through a central aperture therein so that gear 22 is free to rotate about shaft 24 as an axle.

Shaft 24 has a flate circular end cap 26 affixed to it or formed integrally thereon. A spring 28 is coiled coaxially about shaft 24 and is constrained by the end plate 26 and a flate leaf spring 30. Spring 30 has a hole passing therethrough to allow the shaft 24 to pass through it. A retainer ring 32 affixed to the shaft 24 bears against the leaf spring 30. The structure permits linear movement of the shaft 24 along its axis. This motion is essential to the operation of the random switch and will be covered in detail later.

Shaft 24 rotates freely and can slide axially within the central hole in gear 22. Gear 22 has a cylindrical projection which extends from the front face thereof and which is adapted to pass through a bushing 34 mounted in the plate 6.

A drive spring 36 is affixed at one end to and surrounds the cylindrical projection of gear 22 which exits through the plate 6. Spring 36 is coiled about the cylindrical projection of gear 22 and is anchored at one end to the gear which serves to hold gear 22 against plate 6. The other end of the spring has a short segment bent outward at right angles to the axis of the coil. A disk 38, is provided which has a central aperture through which shaft 24 can freely pass. The disk 38 is therefore free to rotate about shaft 24 unless the shaft is in the axial position shown in FIG. 5. Shaft 24 terminates in a flate C-ring type retainer 25 and has a second similar retainer 27 immediately inward from the disk. These two retainers constrain the disk 38 to move with the axial motion of the shaft but permit the disk to rotate about the shaft. Formed integrally on the inward pointing surface of disk 38 are a plurality of vane like projections 40. When the disk 38 is in the axial position shown in FIG. 5 the outwardly extending segment of drive spring 36 engages one of the vanes 40. It is to be noted that the vanes 40 are disposed at an angle with respect to the shaft 24. A pin 42 mounted near the periphery of the disk 38 is adapted to engage a star wheel 44 (FIG. 3) when the shaft 24 is in the axial location shown in FIG. 5. Pin 42, however, becomes disengaged from the star wheel 44 when shaft 24 is moved outward axially as will be explained.

As can best be seen in FIG. 1, the star wheel 44 is affixed to and drives a shaft 46 which is mounted through opposing holes in support plates 4 and 6. A rectangular cam 48, is secured to the shaft 46 by a pin 49 and is rotated by this shaft. One of the four faces of this rectangular cam 48 bears against a switch 50 by means of a switch following arm 52. The fact that this cam is rectangular permits forcing the position of switch following arm 52 into two different positions as will be later explained.

Figure 7:
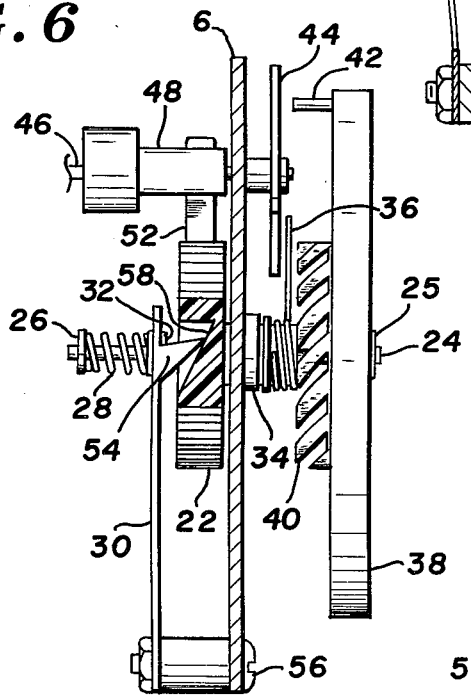
FIG. 7 is the sectional view taken along the line 7—7.

FIGS. 2 and 7 show the left side view of the random switch 2. In these views it can be seen that leaf spring 30 has a triangular shaped projection 54 which normally bears against the inside of gear 22 and thereby holding this gear against plate 6. Spring 30 is secured to the plate 6 at the end opposite the triangular projection by two sets of nuts and bolts 56. Leaf spring 30 is preferrably made of spring steel which permits it to be flexed. With the spring 30 held in the flexed position shown in FIG. 2 by projection 54, spring 28 is compressed and bears against end cap 26, thus moving shaft 24 inward, i.e., to the left in FIG. 5. As mentioned previously with shaft 24 in this inward axial position the projection of drive spring 36 is engaged between two adjacent vanes 40 and the pin 42 is engaged between adjacent arms on the star wheel 44.

Figure 3:
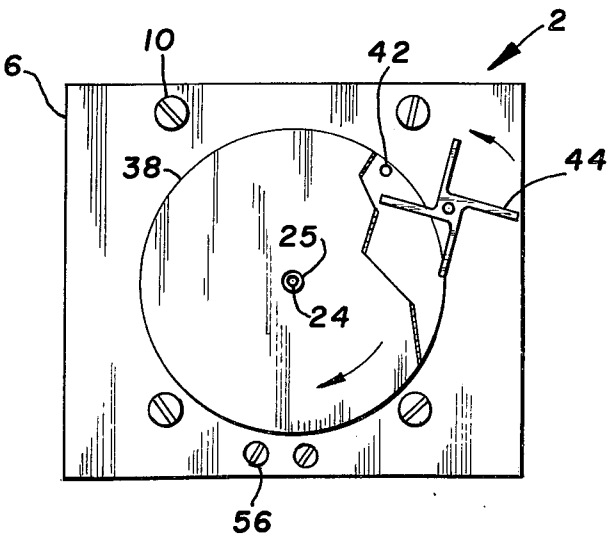
FIG. 3 is the front view of the device.

FIG. 3 illustrates a front view of the random switch 2 with the disk 38 partially cut away to reveal the cooperation of the pin 42 with the arms of the star wheel 44. As the disk 38 rotates in the clockwise direction, the pin 42 will engage one of the arms of star wheel 44 and rotate the star wheel and shaft 46 approximately 90°. Each successive rotation of disk 38 will cause the pin 42 to engage the next arm of the star wheel 44 and rotate it another 90°.

Figure 4:
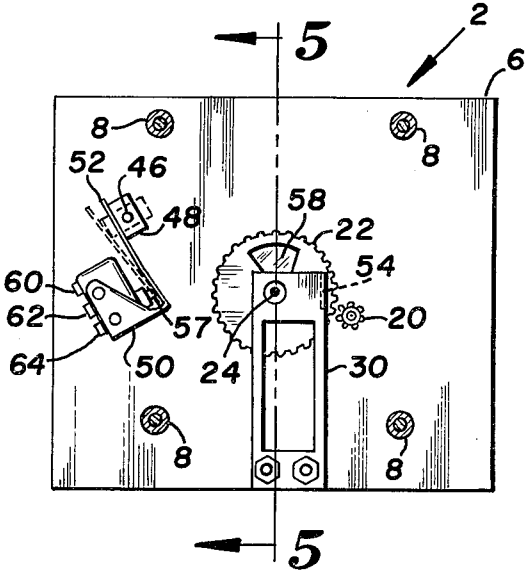
FIG. 4 is a sectional view as indicated on FIG. 2.

FIG. 4 is a sectional view showing a different view of the relationship of the leaf spring 30 with the gear 22 and the rectangular cam 48 with the actuator arm of the switch 50. In this view it can be seen that gear 22 has an opening 58 formed in the rear surface thereof which covers an angle of approximately 45°. In this view projection 54 of leaf spring 30 is not opposite opening 58 but is bearing against the inside surface of gear 22. In this location the shaft 24 is withdrawn and the disk 38 is forced against the bearing surface 34 thereby aligning the projection of drive spring 36 with the vanes 40.

The relationship of rectangular cam 48 to switch 50 can also be seen in FIG. 4. When star wheel 44 is successively rotated ninety degrees by the operation of pin 42, the shaft 46 and rectangular cam 48 are also rotated by the same amount. This brings successive faces of cam 48 into contact with switch following arm 52. This following arm is spring loaded and, as such, it acts as an indexing device to assure that the cam 48 rotates precisely 90°. With the cam 48 in the position indicated by the solid outline, the switch following arm 52 is depressed less than when the cam 48 is in the position 90° later as indicated by the dashed outline. In this second position arm 52 is depressed a greater amount. Switch 50 is preferrably a miscroswitch with an external plunger 57. Thus, the operation of arm 52 alternately depresses and releases plunger 57 which, in turn, changes the internal electrical connections between elements 60, 62 and 64 on the switch.

Figure 5:
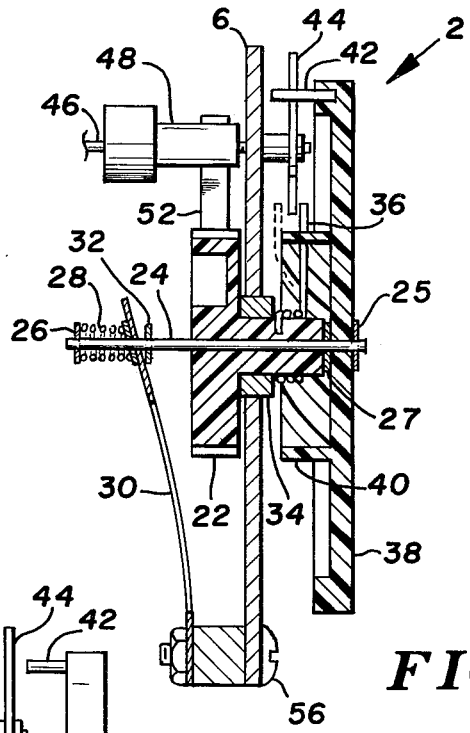
FIG. 5 is a sectional view as indicated on FIG. 4.

FIG. 5 is a detailed side view of the random switch mechanism 2 with the leaf spring 30 deflected by the bearing of the projection of spring 30 against the inner surface of gear 22. This is the same relationship as that shown in FIG. 1 and FIG. 2. Disk 38 is held against bearing 34 by retainer 25 because shaft 24 is held to the left by spring 30. In this position drive spring 36 engages one of the vanes 40 and pin 42 is opposite the star wheel 44 is a position to engage the wheel. Note that if disk 38 were moved to the right, then drive spring 36 would be disengaged from vanes 40 and pin 42 would not mesh with star wheel 44.

Figure 6:
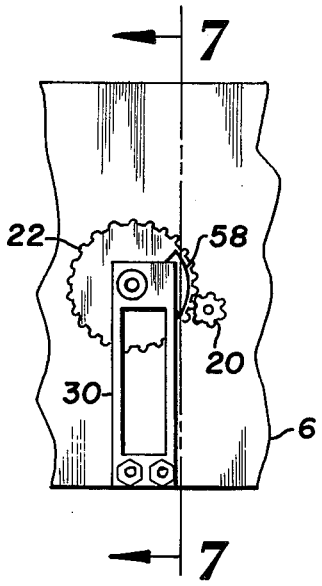
FIG. 6 is a detail of the view of FIG. 4 with gear rotated to a new position.

FIG. 6 and 7 show the relationship when gear 20 rotates gear 22 such that projection 54 is aligned with opening 58 formed in the rear surface of gear 22. It can be seen that projection 54 is within opening 58 in the rear face of gear 22. Note that opening 58 has a face which is shear with respect to the projection 58 and a second face which is inclined with respect to this projection. With the projection 54 in this position within opening 58, spring 28 and spring 30 will both urge shaft 24 to the right by bearing upon retainer 32. This moves vane 40 rightward from drive spring 36 and also moves pin 42 on disk 38 rightward and out of alignment with star wheel 44.

Figure 8:
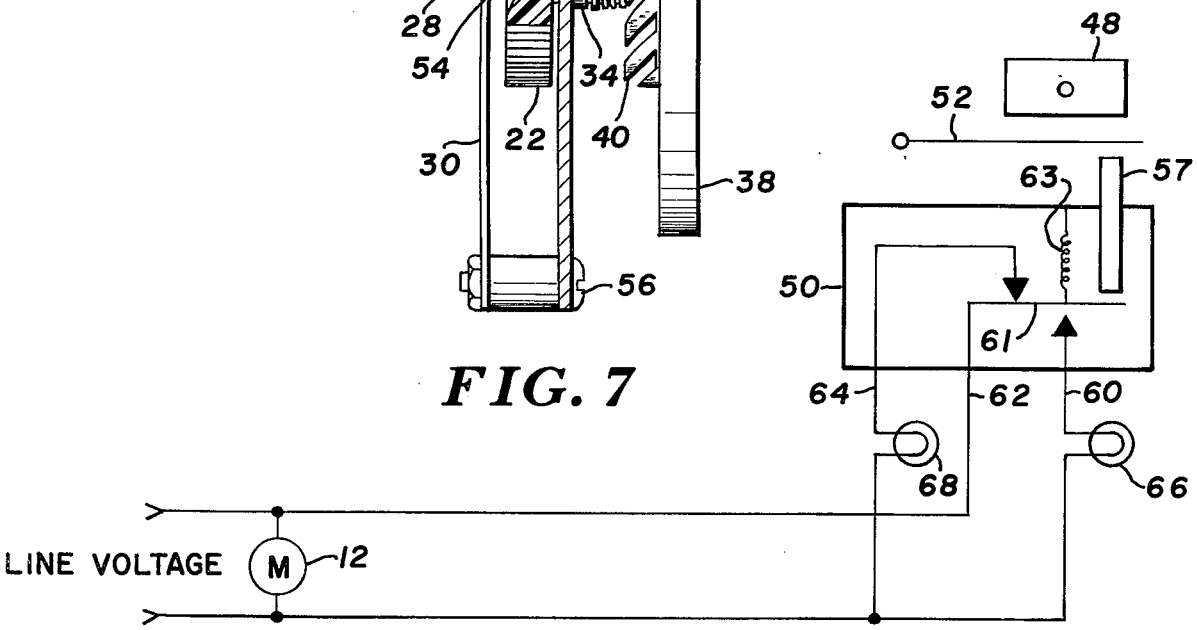
FIG. 8 is a combined circuit diagram and mechanical interaction diagram.

FIG. 8 is a circuit diagram of the random switch 2 which shows the mechanical and electrical interaction. Here cam 48 operates switch following arm 52 which in turn bears upon plunger 57. Plunger 57 in turn operates the arm contact 61 of the switch 50. When plunger 57 is withdrawn then spring 63 holds arm 61 against the contact 64 and when the plunger is depressed, the arm is connected to contact 60. Note that this mechanism could be simplified in that the switch following arm 52 could itself be the arm contact of the switch 50 and provide the switching action directly. in FIG. 8 line voltage is applied at all times to the motor 12 and to the arm contact 62 of switch 50. With the rectangular cam 48 in the position shown, arm 61 is connected to contact 64 and thence to light 68. When cam 48 rotates 90° then the switch will be closed in the opposite direction which will open the connection between contact 61 and 64 and thus deenergize light 68. This same operation will close the connection between contact 62 and contact 60 and thereby energize light 66.

In the operation of this random switch 2, the overall sequence of operations is as follows. Assuming that initially the circuit is energized and that motor 12 is slowly driving gear 22 through gear 20, shaft 18, gear 16 and gear 14 and that projection 54 is bearing against the rear surface of gear 22, as is shown in FIGS. 2, 4, and 5. In this relationship disk 38 will bear to the interior of the random switch 2 and drive spring 36, which is being driven by gear 22, will be engaged with one of the vanes 40, causing disk 38 to rotate with shaft 24. As disk 38 is rotated, whenever pin 42 engages star wheel 44, shaft 46 will be rotated 90°. This rotation will present the next side of the rectangular cam 48 to switch following arm 52 which will in turn change the state of switch 50 in that if light 68 were energized and light 66 were deenergized, then light 68 would be denergized and light 66 energized. If on the other hand light 68 were deenergized and light 66 energized then the opposite energizing sequence would occur.

As gear 22 is driven by the motor 12 it will finally reach the angle of rotation such that the opening 58 will be opposite projection 54 as shown in FIGS. 7 and 8. When this occurs, projection 54 will drop abruptly into the opening 58 due to the sheer face on the opening relative to the projection. This abrupt motion of spring 30 forces shaft 24 rapidly to the right (FIG. 7). This rapid motion to the right quickly disengages drive spring 36 from its matching vane 40 and also at the same time moves pin 42 out of alignment with star wheel 44. This rapid disengagement of drive spring 36 from vane 40 imparts a rotary motion to disk 38 because of the skewed vanes, which now has no impediment to its free rotation. Disk 38 will rotate freely on shaft 24 until friction brings it to a stop in some random position. The disk 38, vane 40 and pin 42 are all effectively one unit and rotate together and all these parts are balanced carefully so that the final position of the disk will not be affected by gravity.

The disengagement of the vanes 40 from drive spring 36 and the rotation of the disk 38 and the disk's gradual stop is rapid compared to the rotation of gear 22 which is driven at a slow speed by the motor 12. After the disk 38 comes to rest the inclined surface of opening 58 will be driven against projection 54 by the rotation of gear 22 and will slowly lift the projection out of the opening. Projection 54 is moved to the left by this operation is viewed as shown in FIG. 7. This motion will in turn move shaft 24 to the left and will reengage drive spring 36 with one of the vanes 40 and will realign pin 42 with the star wheel 44 such that the pin can engage a star wheel arm. This will cause the drive spring 36 to again drive the disk 38 and the pin 42 and whenever the pin 42 is driven against an arm of the star wheel 44 the switch 50 will again be driven to a new state.

The important result of the disengagement of the vanes 40, disk 38 and pin 42 and their free rotation to a new random position is that the resulting location of pin 42 is randomized by this operation. Since the disk 38 can come to a rest at any position when the drive spring 36 reengages the vanes 40, the location of pin 42 bears no relationship to its location immediately before the disengagement. This means that the operation of the switch 2 is random even though the operation of the randomizing mechanism occurs at a regular time interval. This randomizing will occur every time that opening 58 is driven opposite projection 54 by the operation of the motor 12 through the gear trains. The net result is that switch 50 will change its state at unpredictable random intervals which will never occur in a pattern. Since the location of the disk 38 relative to the drive spring 36 is random there is the possibility that the vanes 40 will precisely straddle the drive spring projection. In such a case, as the drive spring 36 projection is deflected by the movement of the disk 38 and vanes 40 inwardly the projection would tend to move into one or the other of the vane openings straddling the projection. If a solid arm were used instead of a spring projection this would be less likely to occur.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the appended claims. As examples of other mechanizations, the single-pole, double-throw switch used here can be replaced by a single-throw, single-pole switch and only one circuit be controlled in a random manner rather then two circuits in a complementary fashion, or a multipole switch could be used to control a number of circuits. Also the mechanism for disengagement could comprise one gear train having a shaft which could move relative to a second shaft which is driven, each having meshing gears such that when one shaft is moved relative to the other, the gears would become disengaged and a rapid rotary motion given to the free shaft, in the same manner as is accomplished by the disclosed embodiment.

Accordingly, the scope of the invention is to be determined by the appended claims.

What is claimed is:

1. Apparatus for operating an electrical switch in a random fashion comprising in combination;

a. first and second mounting plates maintained in a parallel and spaced relationship with one another.

b. a motor mounted on said first plate with its rotor extending through a hole in said plate;

c. a first shaft passing through said second plate and journaled for rotation and translation therethrough;

d. a gear rotatably mounted on said first shaft between said first and second plates, said gear having an aperture formed in the surface thereof opposite to said first plate;

e. a gear train coupling the rotor of said motor to said gear for driving said gear at a constant rotational speed;

f. a leaf-spring mounted at one end to said second plate and having a projection at the other end for normally maintaining said leaf-spring in a flexed condition except when said projection mates with said aperture in said gear, said leaf spring being coupled to said first shaft to cause said shaft to assume a first translational position when said spring is in a flexed condition and a second translational position when said spring projection mates with said aperture in said gear;

g. a disc rotatably mounted on the portion of said first shaft extending through said second plate, said disc. having a pin located at a predetermined radial distance from the axis of said first shaft;

h. means coupling said gear to said disc when said shaft is in its first translational position for imparting rotational motion to said disc as said gear is driven by said gear train;

i. a cam mounted for rotation on a second shaft between said first and second plates and having a portion of said second shaft extending through a hole in said second plate;

j. a star-wheel affixed to said portion of said second shaft and normally oriented in the orbital path traversed by said pin as said disc is rotated; and k. a microswitch mounted on said second plate having its actuator arm cooperating with said cam.

2. Apparatus as in claim 1 wherein the projection on said leaf spring is on a dimension greater than the length, of said pin such that when said projection enters said aperture, said first shaft is displaced a distance sufficient to ensure that said pin will no longer be in the orbital path coincident with said star-wheel.

3. Apparatus as in claim 1 wherein said means coupling said gear to said disc comprises;

a. a coil spring secured at one end to said gear and having a predetermined length of wire at the other end bent outward at an angle with respect to the axis of said coil spring;

b. a plurality of vanes integrally formed on one surface of said disc, said predetermined length of meshing with said vanes except when said projection on said leaf spring is positioned within said aperture in said gear.

4. A device for producing random operations of an electrical switch comprising in combination.

a. a electrical switch having mechanically operated toggling means for reversing the on-off state thereof;

b. a motor;

c. a rotatable disk mounted on an axially movable shaft, said disk having a projection extending from a predetermined point on the disk face;

d. means for mounting said switch with respect to said disk such that said toggling means is in the path of said disk projection when said shaft is in a first axial position and said disk is rotated;

e. a gear train connected to said motor;

f. a gear rotatably mounted on said shaft and connected to said gear train, said gear having an aperture in one face thereof at a predetermined radial location;

g. a normally flexed leaf spring connected to said shaft, said leaf spring having a projection extending in radial coincidence with said aperture location such that as said gear is rotated by said gear train the projection on said leaf spring snaps into the aperture and imparts a sudden axial motion to the shaft to cause the shaft to move out of its first axial position; and h. clutch means for coupling said gear rotating motion to said disk when said shaft is in its first axial position.

5. Apparatus as in claim 4 wherein said axial motion of said shaft orients said projection on said disk in a second path out of engagement with said toggling means.

6. Apparatus as in claim 5 and further including means responsive to said sudden axial motion of said shaft to impart a sudden rotational motion to said disk.

7. An apparatus for producing random operations of an electrical switch, comprising:

a. toggling means connected to said switch for alternately selecting one of two switch operational states;

b. a drive motor;

c. a disk attached to a shaft, said disk having a raised projection on a disk face at a predetermined radial position, said shaft being positioned so as to enable said raised projection to actuate said toggling means at a first disk angular and axial position.

d. a clutch drive mechanism engageable against said disk, said clutch drive mechanism mounted about said shaft and having disk disengagement means for imparting a rotational energy impulse to said disk, and having disk engagement means for imparting a steady rotational movement to said disk;

e. a gear train connected between said drive motor and said clutch drive mechanism to cause rotation of said clutch drive; and f. control means for engaging and disengaging said clutch drive mechanism, said control means including a cam surface on said clutch drive and a spring loaded cam follower connected to said shaft to impart axial movement thereto and thereby move said disk into and out of said first axial position.

8. The apparatus of claim 7 wherein said toggling means further comprises an actuating lever connected to said switch; a rectangular cam surface contacting said actuating lever: and a rotatable star wheel connected to said rectangular cam surface, said star wheel being rotatably movable by said disk raised projeciton.

9. The apparatus of claim 8, wherein said disk raised projection further comprises a pin attached to said disk face.

* * * * *